US007752832B2

(12) United States Patent
Lee

(10) Patent No.: US 7,752,832 B2
(45) Date of Patent: Jul. 13, 2010

(54) APPARATUS FOR PRODUCING A YARN

(75) Inventor: David Arthur Lee, Christchurch (NZ)

(73) Assignee: Summit Wool Spinners Limited, Oamaru (NZ)

( * ) Notice: Subject to any disclaimer, the term of this patent is extended or adjusted under 35 U.S.C. 154(b) by 1057 days.

(21) Appl. No.: 10/534,957

(22) PCT Filed: Nov. 14, 2003

(86) PCT No.: PCT/NZ03/00253

§ 371 (c)(1),
(2), (4) Date: Dec. 9, 2005

(87) PCT Pub. No.: WO2004/044290

PCT Pub. Date: May 27, 2004

(65) Prior Publication Data

US 2006/0144033 A1 Jul. 6, 2006

(30) Foreign Application Priority Data

Nov. 14, 2002 (NZ) ..... 522596
Mar. 28, 2003 (NZ) ..... 525019
Apr. 14, 2003 (NZ) ..... 525308

(51) Int. Cl.
*D02G 3/00* (2006.01)

(52) U.S. Cl. ..... 57/293; 57/335

(58) Field of Classification Search ..... 57/293, 57/314, 332, 335
See application file for complete search history.

(56) References Cited

U.S. PATENT DOCUMENTS 2,577,793 A * 12/1951 Miller ..... 118/44
3,443,370 A * 5/1969 Walls ..... 57/293
4,279,120 A * 7/1981 Norris ..... 57/204
4,712,365 A 12/1987 Ferrer
5,094,068 A * 3/1992 Hirao ..... 57/334
6,324,872 B1 12/2001 Blaszyk et al.
6,655,122 B2 * 12/2003 Shigeyama et al. ..... 57/5

FOREIGN PATENT DOCUMENTS

| | | |
|---|---|---|
| AU | 288664 | 4/1967 |
| AU | 26099/67 | 9/1968 |
| AU | 405827 | 2/1969 |
| AU | 455170 | 8/1972 |
| AU | 488616 | 10/1976 |
| DE | 1685645 | 7/1971 |
| DE | 100 32 708 | 1/2002 |
| DE | 100 25 858 | 9/2002 |
| JP | 1-260029 | 10/1989 |

(Continued)

*Primary Examiner*—Shaun R Hurley
(74) *Attorney, Agent, or Firm*—Dann, Dorrman, Herrell and Skillman, P.C.

(57) ABSTRACT

An apparatus for producing a yarn including reciprocating twisting stage (4) adapted to simultaneously twist one or more slivers to produce one or more twisted strands, including one or more rollers (6*a*, 6*b*) arranged to move reciprocally (B) along the axis of rotation of the roller(s) to input twist to the sliver(s), and control means enabling control and variation of one or more of: (a) rotation speed of the rollers(s); (b) extent of transverse movement of the roller(s)s; or (c) speed of the transverse movement of the roller(s), to vary the twist imparted to the sliver(s) or strand(s).

34 Claims, 9 Drawing Sheets

FOREIGN PATENT DOCUMENTS

| | | |
|---|---|---|
| JP | 4-40778 | 4/1992 |
| JP | 4-163331 | 6/1992 |
| JP | 8-246280 | 9/2005 |
| NZ | 336048 | 1/2001 |
| WO | 97/30945 | 8/1997 |

* cited by examiner

APPARATUS FOR PRODUCING A YARN

FIELD

The invention relates to apparatus for producing a yarn, which provides controllable variation of a degree of twist in the yarn or more generally of the twist profile of the yarn.

BACKGROUND

In producing a yarn formed of staple fibres or predominantly of staple fibres, such as wool, cotton, synthetic staple fibres, or a mixture of such fibres, a number of slivers may, typically after drafting, be passed through a twisting stage which comprises reciprocating rotating rollers which move from side to side as the slivers pass between the rollers, thereby imparting a twist to the strands. After exiting the twist rollers, the strands are brought together to twist naturally with each other to form a multi-ply yarn. Apparatus or machines for so producing a yarn are disclosed in Australian patent specifications 51009/64, 9432/66, 26099/67, and 25258/71.

New Zealand patent 336048 discloses a method for producing a yarn comprising three or more slivers, or ends, in which the three slivers are passed between reciprocating twist rollers and then one or more of the slivers is passed over a path of a different length before the slivers are brought together. Rather than all of the slivers or ends passing through the twisting stage together and then being twisted naturally together, the twist in one or more of the slivers or ends is staggered or out of phase relative to the twist in the other slivers.

SUMMARY OF INVENTION

The present invention provides an improved or at least alternative apparatus for producing a yarn comprising a plurality of twisted strands, which enables aspects of the twist profile imparted to the yarn to be controllably varied, and thus properties of the yarn or fabric or knitted or woven products formed from the yarn to be influenced.

In one aspect the invention broadly comprises apparatus for producing a yarn including a reciprocating twisting stage adapted to simultaneously twist one or more slivers to produce one or more twisted strands, including one or more rollers arranged to move reciprocally along the axis of rotation of the roller(s) to impart twist to the sliver(s), and a control system which enables control and variation of the rotational speed of the one or more rollers to vary the twist imparted to the slivers or strands.

In another aspect the invention broadly comprises apparatus for producing a yarn including a reciprocating twisting stage adapted to simultaneously twist one more slivers to produce one or more twisted strands, including one or more rollers arranged to move reciprocally along the axis of rotation of the roller(s) to impart twist to the sliver(s), and so mounted that the extent of the transverse reciprocal movement of the roller(s) can be controlled and varied to vary the twist imparted to the sliver(s) or strands.

In another aspect the invention broadly comprises apparatus for producing a yarn including a reciprocating twisting stage adapted to simultaneously twist one more slivers to produce one or more twisted strands, including one or more rollers arranged to move reciprocally along the axis of rotation of the roller(s) to impart twist to the sliver(s), and control means enabling control and variation of the speed of the transverse reciprocal movement along the axis of rotation of the roller(s) to vary the twist imparted to the sliver(s) or strands.

In another aspect the invention broadly comprises apparatus for producing a yarn including a reciprocating twisting stage adapted to simultaneously twist one or more slivers to produce one or more twisted strands, including one or more rollers arranged to move reciprocally along the axis of rotation of the roller(s) to impart twist to the sliver(s), and a control system which enables control and variation of the rotational speed of the one or more rollers and of the speed of reciprocal movement along the axis of rotation of the roller(s) to vary the twist imparted to the slivers or strands.

In another aspect the invention broadly comprises apparatus for producing a yarn including a reciprocating twisting stage adapted to simultaneously twist one more slivers to produce one or more twisted strands, including one or more rollers arranged to move reciprocally along the axis of rotation of the roller(s) to impart twist to the sliver(s) and so mounted that the extent of the transverse reciprocal movement of the roller(s) can be varied and a control system which enables control and variation of the rotational speed of one or more rollers and of the extent of transverse reciprocal movement of the roller(s), to vary the twist imparted to the sliver(s) or strands.

In another aspect the invention broadly comprises apparatus for producing a yarn including a reciprocating twisting stage adapted to simultaneously twist one more slivers to produce one or more twisted strands, including one or more rollers arranged to move reciprocally along the axis of rotation of the roller(s) to impart twist to the sliver(s), and control means enabling control and variation of the speed of the reciprocal movement along the axis of rotation of the roller(s) and of the extent of transverse reciprocal movement of the roller(s), to vary the twist imparted to the sliver(s) or strands.

In another aspect the invention broadly comprises apparatus for producing a yarn including a reciprocating twisting stage adapted to simultaneously twist one or more slivers to produce one or more twisted strands, including one or more rollers arranged to move reciprocally along the axis of rotation of the roller(s) to impart twist to the sliver(s), and a control system which enables control and variation of the rotational speed of the one or more rollers, and the speed of reciprocal movement and the extent of the transverse reciprocal movement of the roller(s) to vary the twist imparted to the slivers or strands.

Preferably the control system of the apparatus facilitates control and variation of all of the transverse speed, the extent of the transverse reciprocal movement, and the rotational speed of the one or more rollers, to enable wide variation of the twist profile imparted to the slivers and to in turn enable the production of yarns having a wide range of different twist profiles. In turn, fabrics or knitted or woven products formed from the yarns can have a wide range of different fabric or product properties for different fabric or product applications.

Preferably the control system includes a microprocessor, programmable logic controller or similar which controls the traverse reciprocal movement, and/or the rotational speed of the one or more rollers, and an associated user interface through which a user may programme the twist profile to be imparted to any particular production run, series of production runs, or part run of yarn.

Preferably the apparatus also includes one or more guides positioned such that one or more of the strands passes over a longer path than one or more other strands before the strands are brought together to form a multi-ply yarn and a guide reposition system for varying the position of one or more guides between or during a production run. A guide reposition system may include an electro-mechanical guide adjustment mechanism for moving one or more guides, also under programmable control of a microprocessor-based or similar control system.

BRIEF DESCRIPTION OF THE DRAWINGS

Forms of apparatus of the invention are described with reference to the accompanying drawings by way of example and without intending to be limiting, wherein.

DETAILED DESCRIPTION OF PREFERRED FORMS

Figure 2:
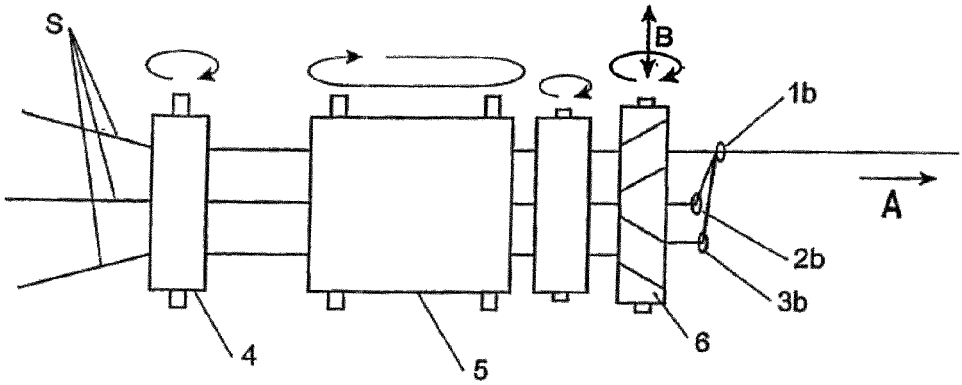

Referring to FIG. 2 a first preferred form apparatus comprises a drafting unit 5 comprising opposed moving preferably rubber coated rollers or belts, between which the fibres pass (as slivers). In the example shown, three slivers S (unspun) of for example wool drawn from drums or other bulk supply (not shown), are fed between rollers 4 and through the drafting unit 5 and are drawn out—typically the thickness of a wool fibre assembly is reduced to between one half to one twenty-fifth of the initial thickness. The amount of thickness reduction may be adjusted by altering the rotational speed of the drafting unit. The direction of travel of the slivers through the apparatus is indicated by arrow A in FIG. 2.

Figure 3:
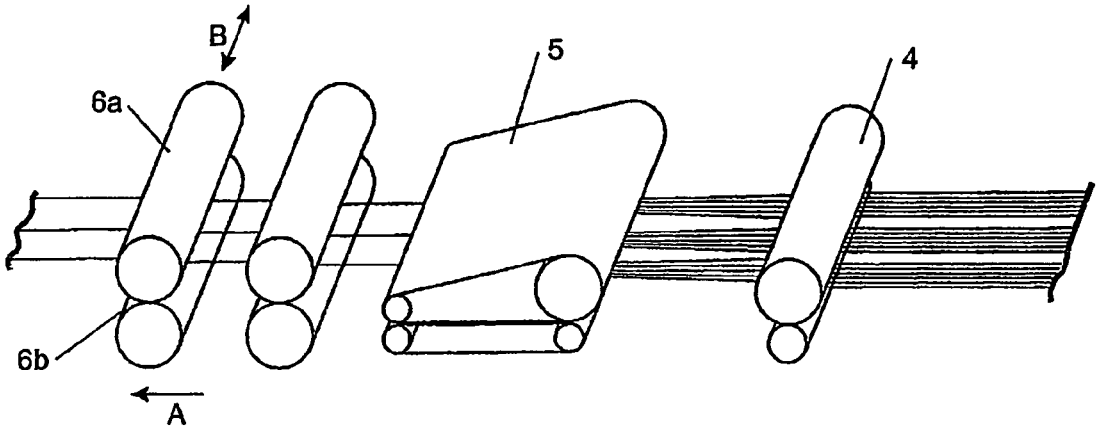
FIG. 3 shows major parts of the apparatus from one side, showing the drafting unit and twist rollers thereof.
Figure 4:
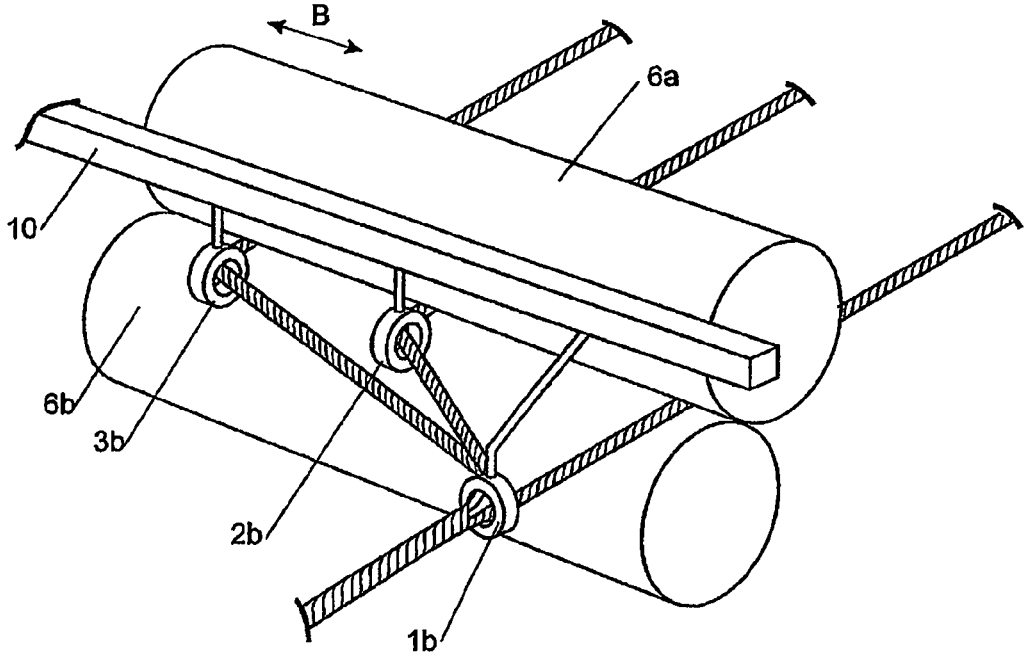
FIG. 4 shows the strands exiting the twist rollers being brought together by guides, FIGS. 5A and 5B schematically show systems for driving the twist rollers, FIG. 6 schematically shows another form of apparatus of the invention similar to that of FIG. 2 from above which comprises two sets of twist rollers.

A reciprocating twisting stage 6 comprises a pair of rotating rollers 6*a* and 6*b* (see FIGS. 3 and 4), one or both of which also reciprocate back and forth as indicated by arrow B in FIGS. 3 and 4 across the direction of movement of the strands as the machine operates. The twist rollers 6 impart twist to the slivers passing between the rollers in one direction as the roller(s) move(s) one way, followed by twist in the opposite direction as the roller(s) move(s) the other way in operation. The length of each area of twist in the slivers S may be controlled by controlling the transverse speed of the oscillating movement of the rollers 6*a* and 6*b* relative to their forward rotational speed. A slow transverse speed relative to a certain forward rotational speed will generate longer areas of twist in the slivers, first in one direction and then the other. In addition, areas of non-twist may be fanned in the strands at the point at which the roller(s) change(s) direction. If the rollers change direction relatively quickly at each end of their transverse reciprocal movement then there will be only a relatively small area of non-twist between each area of opposite twist, whereas by causing the rollers to change direction relatively slowly at or towards the end of their transverse movements, or pause, relatively longer areas of non-twist will be formed in the slivers which may assist in giving the finished yarn bulk (as well as strength from twist) and less prickle.

Alternatively a single reciprocating roller may move relative to a flat surface over which the strands pass, to twist the strands between the roller and surface.

The extent of the transverse reciprocating movement or throw of the rollers 6*a* and 6*b* may be varied relative to their forward rotational speed to achieve the desired degree of twist in the strands or twist profile of the yarn. Additionally or alternatively the desired degree of twist may be obtained by varying the rotational speed of the twist rollers 6*a* and 6*b*. Additionally or alternatively again the degree of twist or twist profile may be varied by adjusting the speed of reciprocating the transverse movement of the twist roller(s) (relative to their rotational speed). Any one or more but preferably all of the variation in the speed of transverse movement and/or extent or throw and/or rotational speed of the twist roller(s) may be controlled by a microprocessor-based control system having an associated user interface. A user may programme into the machine any desired roller speed, extent of roller transverse movement, rate of roller transverse movement, or a combination of all three, for any production run to achieve a desired twist profile in the strands or resulting multi-ply yarns.

Yarns produced with different roller speeds and movement will have different properties, and will in turn produce fabrics with different properties or knitted or woven products formed from the yarns with different properties. Thus the machine may produce yarns programmed or engineered to have a wide range of different properties, for different end applications in fabrics or products. The yarns may thus be engineered to have superior properties, as shown by the comparative trials for socks knitted with yarn formed on apparatus of the invention as subsequently described.

Figure 5A:
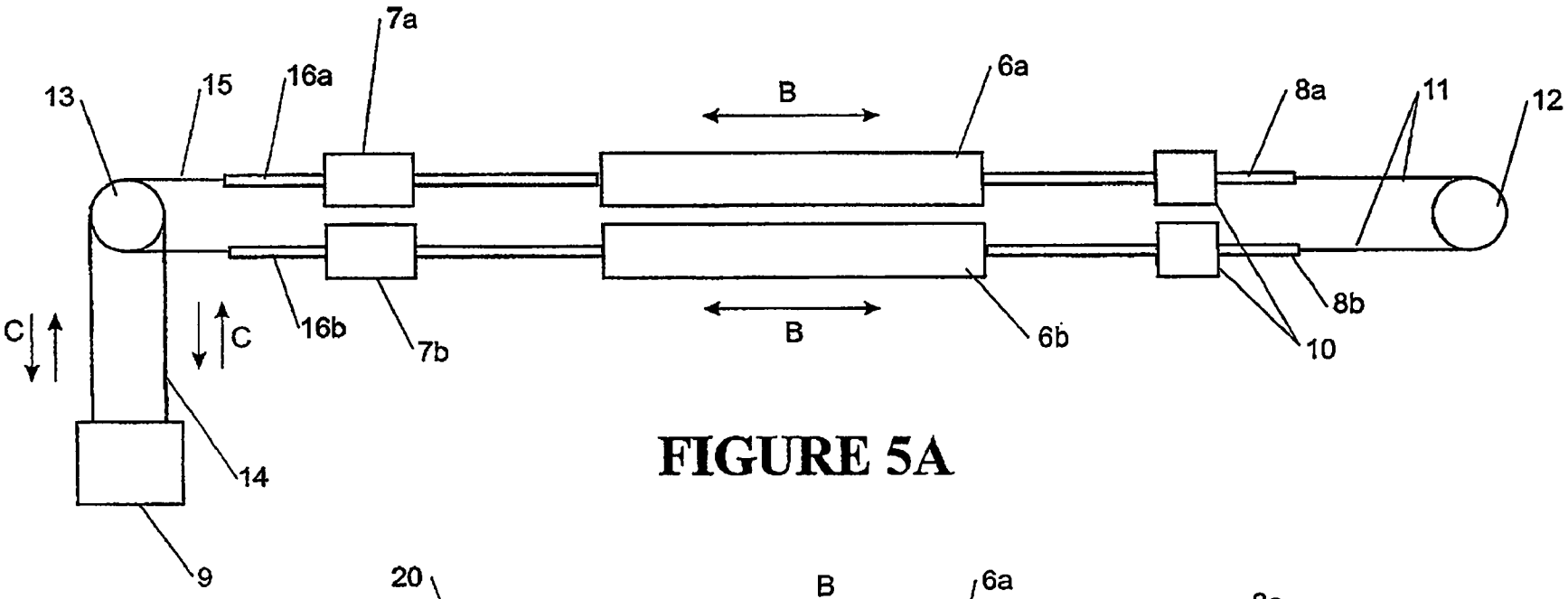

Referring to FIG. 5A, in the arrangement shown electric motors 7*a* and 7*b* drive rotation of the twist rollers 6*a* and 6*b*. The rotational speed of rollers 6*a* and 6*b* may be varied by varying the speed of the electric motors 7*a* and 7*b*. The roller drive motors may be controlled by a user programmable microprocessor-based control system as referred to. In addition electric motor 9 such as a servomotor drives the reciprocal movement of the twist rollers 6*a* and 6*b*, and may be programmably controlled to vary the speed and extent of reciprocal transverse movement of the twist rollers. Servomotor 9 or gear drives a pulley or sprocket (not shown) which rotates and counter rotates and is connected to cable or chain 14 which extends about pulley or gear 13. Cable or chain 15 also extends about pulley or gear 13 and is connected at one end to shaft 16*a* and at the other end to shaft 16*b*, via swivels or similar. Rotation and then counter rotation of the output of the motor 9 drives the cable 15 as indicated by arrows C and thus the twist rollers 6*a* and 6*b* back and forth with a reciprocal movement. That is, movement of cable or chain 14 in an anti-clockwise direction by servomotor 9 will cause cable or chain 15 to move in an anti-clockwise direction and roller 6*a* to move transversely in one direction and roller 6*b* to move transversely in the opposite direction, as both rollers rotate, and vice versa when servomotor 9 reverses its direction. The twist roller shafts 8*a* and 8*b* attach to cable or chain 11 at their other ends, which passes about pulley or gear 12, via swivels or similar.

The rollers 6*a* and 6*b* maybe mounted for rotational movement and reciprocating side movement by the roller shafts 8*a* and 8*b* passing through slide bearings 10 on one or both sides (shown on one side only—the right hand side of FIG. 5A) or similar. The roller shafts 8*a* and 8*b* may pass slidingly through electric motors 7*a* and 7*b* which drive the rollers while also allowing for the sideways reciprocal movement of the rollers/roller drive shafts. Alternatively telescopic couplings may be provided between the roller drive shafts and the rotational drive motors 7*a* and 7*b*.

Figure 5B:
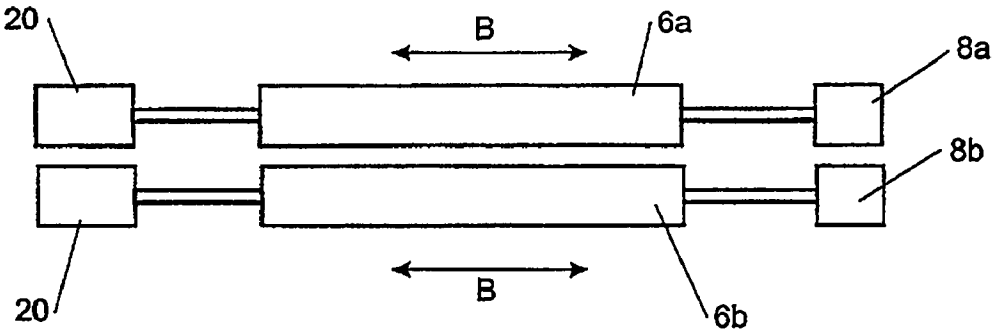

Variation in the throw and/or rotational speed of the twist rollers may be achieved without the use of servomotors by using other suitable equivalent mechanical or electro-mechanical means. FIG. 5B shows an alternative drive system for twist rollers 6*a* and 6*b*. In this case, the rollers are each both caused to rotate and move transversely by electric motors 20 which not only rotate an output drive shaft but also move their output drive shafts axially as they rotate. The rotational speed and extent of axial or transverse movement of each of the motors 20 may be programmably controlled by the control system of the machine.

Figure 1A:
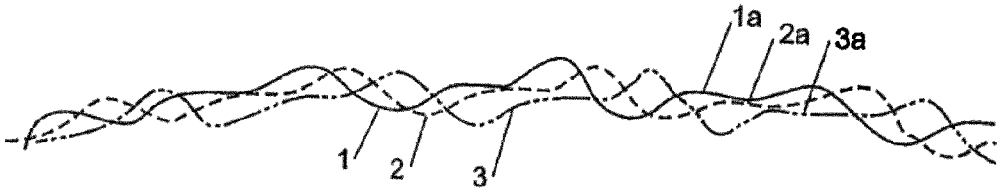
FIG. 1A is a view of a length of one example of yarn which may produced by the apparatus of the invention, and FIG. 1B schematically shows relative positions of the twisted areas in each strand making up the yarn, FIG. 2 schematically shows one form of apparatus of the invention from above.
Figure 1B:
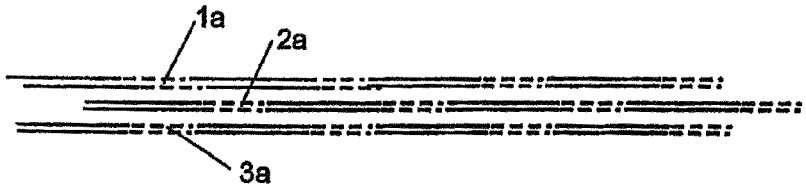

Referring to FIG. 4 following the reciprocating twisting stage, to produce one form of yarn one or more of the strands is led directly through primary guide or eyelet 1*b*, while the other strands are led through secondary guides or eyelets before also passing through primary guide 1*b*, so that some strands have a different path length before entering primary guide 1*b*. Stand 2 passes through guide 2*b* whilst strand 3 passes through guide 3*b* before both passing through primary guide 1*b*. As the stands exit the eyelet 1*b* they tend to self-twist together, or alternatively, a further twisting mechanism may optionally be provided to assist in twisting the three (or more) strands together to form the finished yarn. Such a further twisting mechanism may be controlled to enable the extent to which the individual strands are twisted together to be varied ie to enable control of the "twist within the twist" of the yarn. Each of the strands may pass over a path of different length relative to the other strands, so that the areas of twist in each of the stands are staggered, or out of phase, relative to one another. In this form of yarn the different path lengths are such that areas of non-twist in each strand are overlaid with areas of twist in other strands in the finished yarn. An example of a resulting yarn is schematically shown in FIGS. 1A and B. Referring to FIGS. 1A and 1B, the yarn example illustrated comprises three twisted strands which are loosely twisted together to form the finished yarn. Each of the strands 1, 2, and 3 are "staggered", or out of phase, relative to each other, so that areas of non-twist 1*a*, 2*a*, and 3*a* in each of the strands of the yarn are overlaid by areas of twist in the other stands, as shown. FIG. 1A exaggerates this for clarity. In the finished yarn, the areas of non-twist in one strand are overlaid by areas of twist in the other strands. FIG. 1B seeks to schematically illustrate this—in FIG. 1B the three strands are shown parallel (before any twisting together) and in each strand the areas of twist (in alternate directions) formed by the twist roller(s) 6 are indicated in hard outline while the areas of non-twist between the areas of twist are indicated in broken outline, as indicated at 1*a*, 2*a*, and 3*a*, for example. Any area of non-twist in any strand, such as non-twist area 1*a*, is overlayed for at least part of its length by areas of twist in the other strands as shown.

In a further embodiment, the apparatus of the invention may be capable of adjusting the position of the guides or eyelets or their mechanical equivalent, which bring the individual strands together, to vary the point of overlap or relative phase of the strands. For example the guides 1*b*, 2*b* and 3*b* or equivalent may be mounted to a geared track carried by transverse mounting bar 10 in FIG. 4, and each have a small associated electric motor which may be driven to move the guides, one or more at a time, along the mounting bar 10. The adjustment of the eyelets, or their equivalent, may also be programmably controlled by a microprocessor-based control system of the apparatus which also controls and enables programmable variation of the twist roller rotational and transverse speed and transverse movement.

Figure 6:
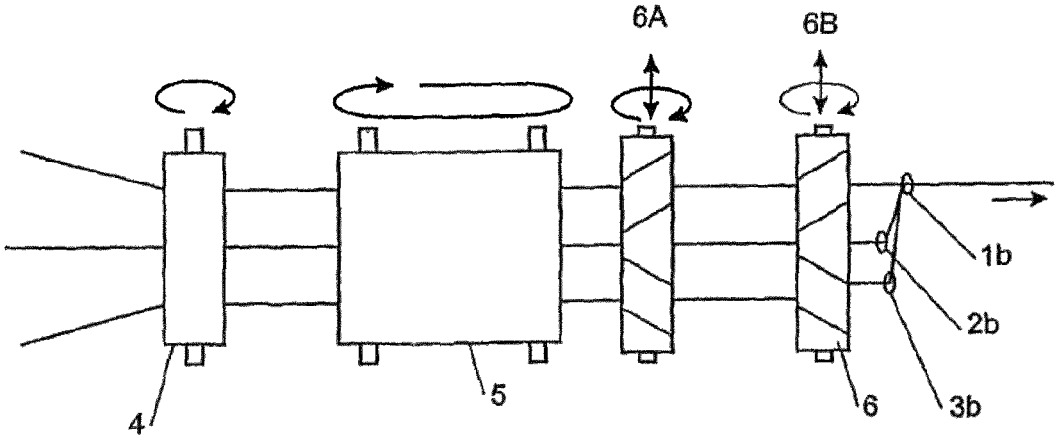
Figure 7:
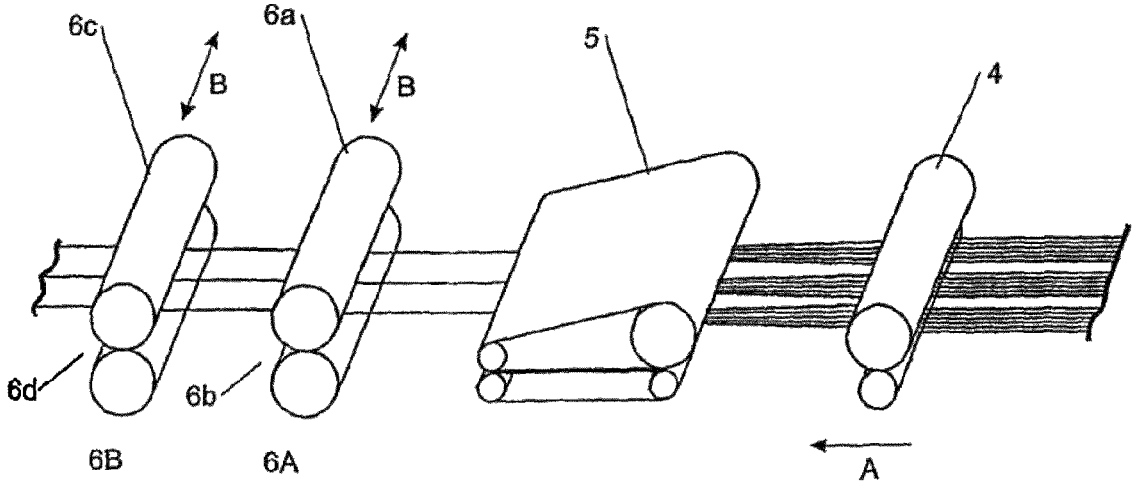
FIG. 7 shows major parts of the apparatus of FIG. 6 from one side.
Figure 8:
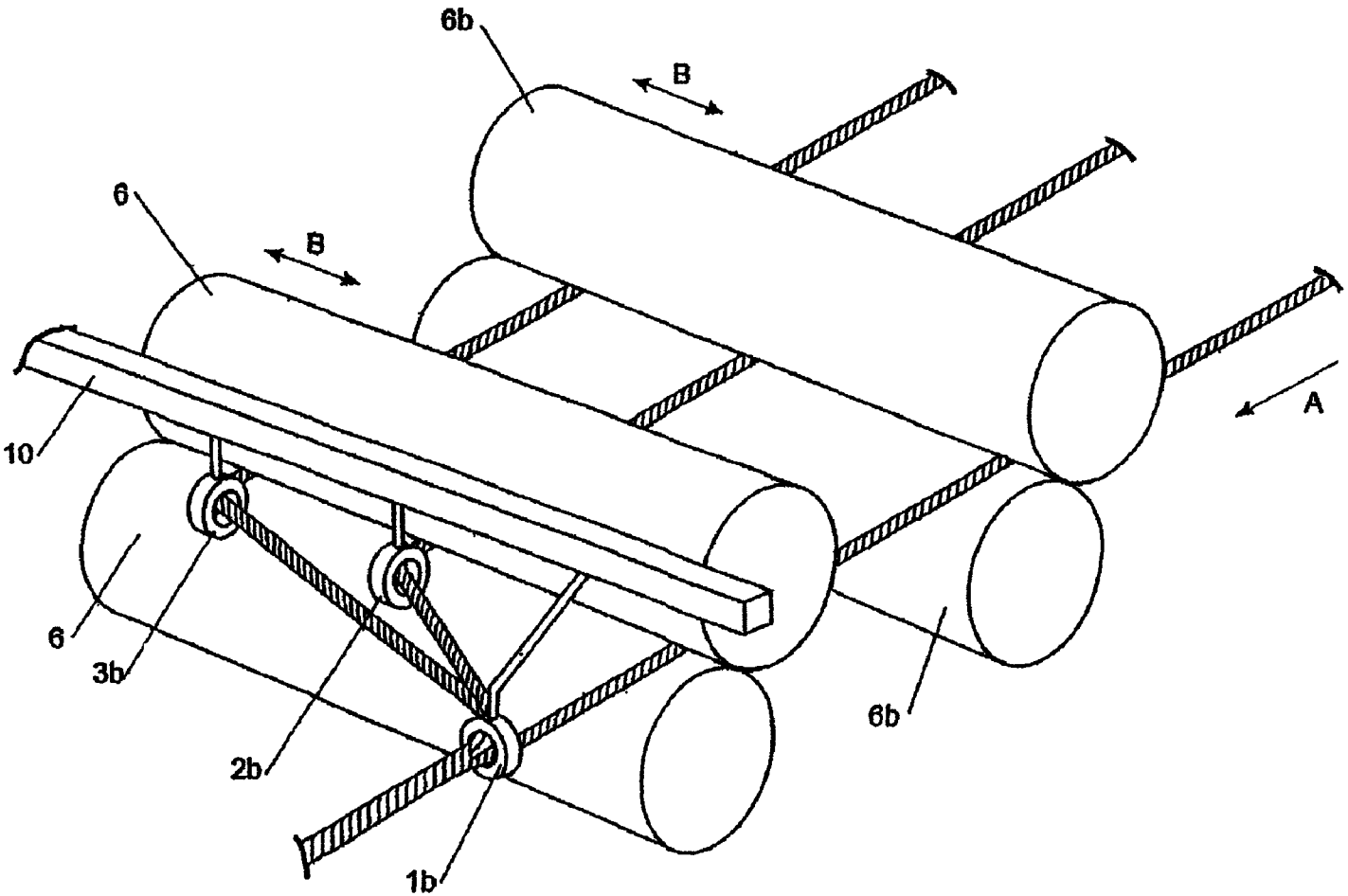
FIG. 8 shows the strands exiting the two sets of twist rollers of the apparatus of FIGS. 6 and 7 being brought together by guides.

Referring to FIGS. 6 to 8 a second preferred form apparatus similarly comprises a drafting unit 5 comprising opposed rollers or belts, between which the fibres pass (as slivers) from a bulk supply (not shown). The slivers S are fed between rollers 4 and through the drafting unit 5 and are drawn out. A first reciprocating twisting stage 6A comprises a pair of rollers 6*a* and 6*b* (see FIGS. 7 and 8), one or both of which rotate as well as reciprocate back and forth as indicated by arrows B across the direction of movement A of the strands as the machine operates. In this embodiment a second reciprocating twisting stage 6B is provided which comprises a second pair of rollers 6*c* and 6*d* one or both of which rotate as well as reciprocate back and forth across the direction of movement of the strands as the apparatus operates. The twist rollers 6*c* and 6*d* also impart twist in one direction as the roller(s) move(s) one way followed by twist in another direction as the roller(s) move(s) the other way in operation. Alternatively in each case again a single reciprocating roller may move relative to a flat surface over which the strands pass, to twist the strands between the roller and surface.

Areas of non-twist tend to be formed in the strands at the point at which the first pair of roller(s) 6A change(s) direction. Transverse movement of the second pair of twist rollers 6B may be at a similar speed to but out of phase with transverse movement of the first pair of rollers 6A, so that the second roller pair 6B will apply twist to the areas of non-twist in the stands which occur at the points in the strands where the first roller pair 6A changes transverse direction.

The extent of the transverse reciprocating movement or throw of the rollers 6*a* and 6*b*, and 6*c* and 6*d*, may be varied to achieve the desired degree of twist in the strands or twist profile of the yarn. Additionally or alternatively the desired degree of twist may be obtained by varying the rotational speed of the twist rollers. Additionally or alternatively again the degree of twist or twist profile may be varied by adjusting the speed of reciprocating the transverse movement of the twist roller(s) (relative to their rotational speed). The variation in the speed of transverse movement and/or throw and/or rotational speed of the twist roller(s) may be controlled by a microprocessor-based control system. One of the two or more pairs of twist rollers may have a greater or lesser transverse throw movement than one or more of the other pairs of twist rollers. The rotational speeds of the multiple pairs of twist rollers may also differ. A user may programme roller seed, the extent of roller transverse movement, and the rate of roller transverse movement, similarly or differently for each of the two twist roller pairs, for any production run to achieve a desired twist profile in the strands or resulting multi-ply yarns.

Similar arrangements to those previously described and shown in FIGS. 5A and 5B or any other suitable mechanical or electro-mechanical equivalent system may drive transverse movement of the roller pairs 6A and 6B but with the transverse movement non-synchronised, so that for example when the rollers 6*a* and 6*b* are at the outer most extent of their transverse movement and are changing transverse direction, the rollers 6*c* and 6*d* are midway through their transverse movement.

In a variation on this embodiment, one or both of the two (or more) pairs of twist rollers may be arranged to also move reciprocally back and forth in the direction of travel of the silvers through the machine, ie along an axis transverse to the rotational axis of the rollers, to vary the spacing between the pairs of rollers as the machine operates, to again vary the twist properties that are imparted to the yarn.

Figure 9:
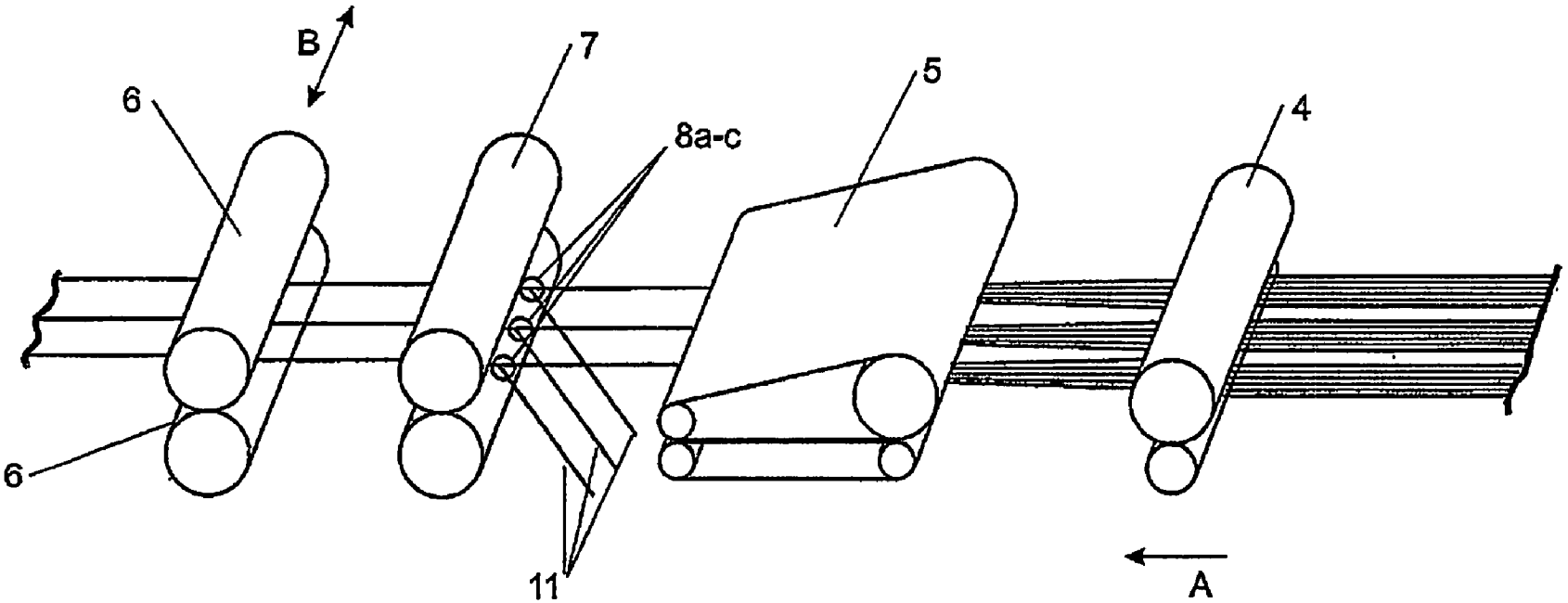
FIG. 9 is a view of major parts of a further apparatus of the invention from one side similar to FIGS. 3 and 7.
Figure 10:
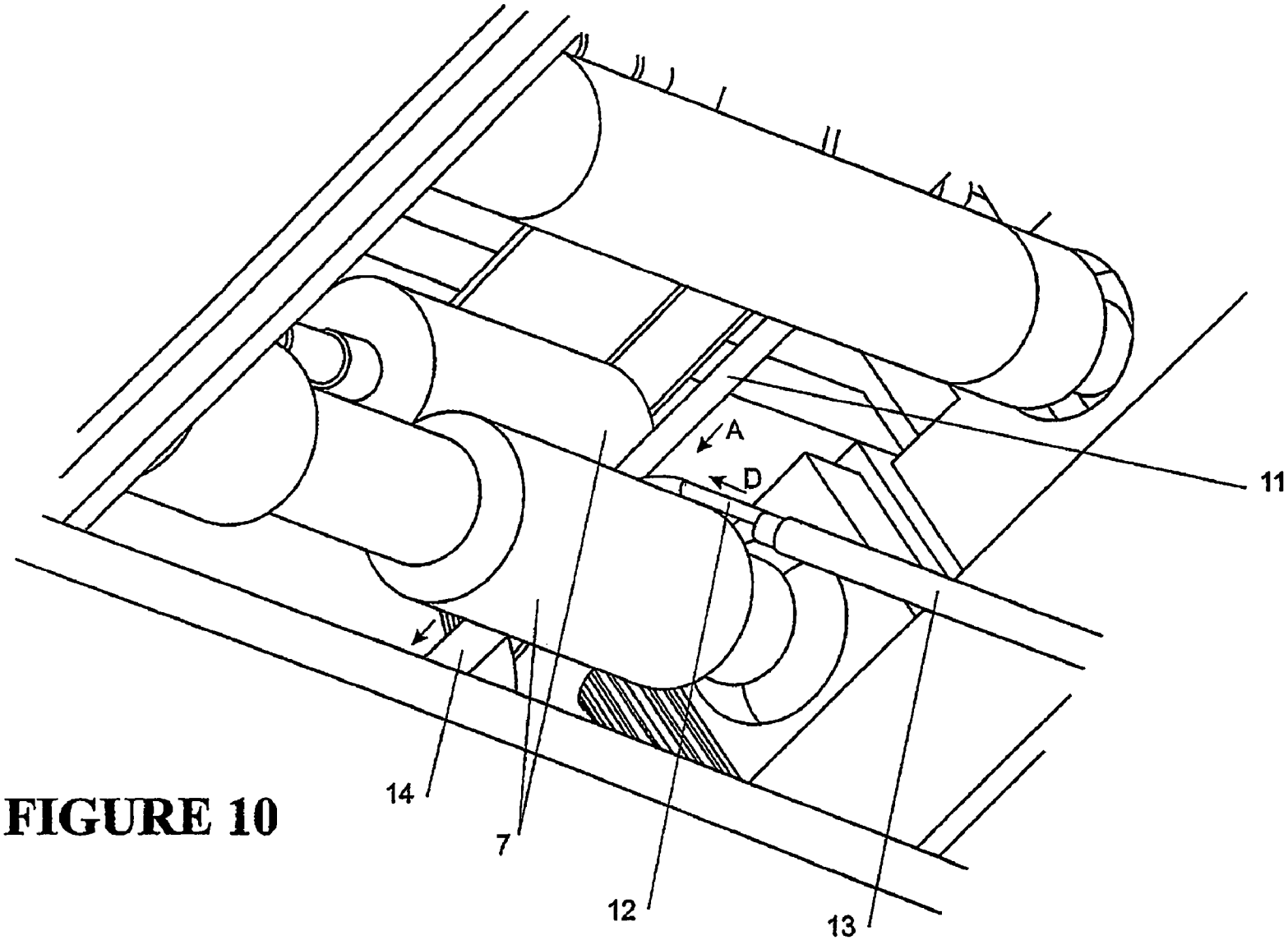
FIG. 10 is a close up view from below showing introduction of one continuous filament through a guide in another form of apparatus similar to that of FIG. 9, and FIGS. 11 and 12 are graphs indicating the moisture vapour absorption of socks knitted with yarn produced apparatus of the invention relative to other types of socks, as referred to in the comparative trials descried subsequently.

Referring to FIGS. 9 and 10 a further preferred form apparatus again comprises an initial optional roller pair 4 and a drafting unit 5 comprising opposed rollers or belts, between which the fibres pass (as slivers). A reciprocating twisting stage 6 comprises a pair of rollers 6*a* and 6*b*, one or both of which rotate as well as reciprocate back and forth across the direction of movement of the strands as the apparatus operates. Prior to the reciprocating twist rollers 6*a* and 6*b* non-reciprocating rollers 7 are provided, with associated ring guides 8*a-c*. Each strand or sliver passes through one of the guides and between rollers 7. Continuous filaments 12 are introduced at and pass through the guides with the strands also, and between the rollers 7. Preferably the continuous filaments are a synthetic monofilament such as a nylon monofilament, but each might alternatively be a synthetic multifilament or a non-synthetic spun filament for example. As each strand of wool for example and filament pass through a guide 8*a-c* and between rollers 7, the continuous filament is pressed into the strand or sliver between the rollers 7, before the strand and filament pass through and are twisted by the reciprocating twist roller 6. Alternative to providing two rollers 7 for this purpose, the strands and filaments may pass between a single roller acting against a flat surface over which the strands pass, to press the filaments into the strands between the roller and surface. The filaments are pressed into the middle of the filaments composed at least predominantly of staple fibres, so that the synthetic filament becomes surrounded by the fibres of the strand. The continuous synthetic filament adds strength to the strand which as a result can be twisted less to achieve higher bulk thus providing a yarn with greater bulk for a given weight of wool, without loss of tensile strength.

FIG. 10 is a close up view from below of a similar form of apparatus of the invention slightly different to that of FIG. 9 but in which again continuous filaments are introduced to the strands of staple fibres between rollers, in close up view from below. Reference numeral 7 in FIG. 10 indicates rollers which perform the same purpose as rollers 7 in FIG. 9. A strand of wool or similar is indicated schematically at 11. A synthetic filament 12 passes through tubular guide 13 in the direction of arrow D and between the roller 7 where it is pressed into the fibres of the strand or sliver 11 as before. The strand incorporating the continuous synthetic filament embedded therein is indicated at 14 exiting the rollers 7 on the other side.

Most preferably machines of the invention include a control system which enables programmably variable rotational speed of the twist rollers, speed of transverse movement of the twist rollers, and extent of transverse movement of the twist rollers, or multiple pairs of twist rollers. Yarns having a wide range of different twist properties may be produced on one such machine, which in turn enables production of fabrics or knitted or woven products formed from the yarns which have a wide range of different fabric or product properties, for different fabric, or product applications; Yarns may be engineered to optimise desired performance characteristics of the fabrics or products produced from the yarns. Varying the twist level along the length of the yarns may enable optimising of the bulk or strength of the yarn. The exposed surface of the component fibres may be altered with different twist properties to more effectively optimise specific physical properties such as for example the ability of the wool to absorb and desorb moisture or moisture vapour. Fibre shedding and/or pilling may be reduced by twisting briefly tightly at intervals less than the staple length of the component fibres. The shock absorption properties of a terry sole structure in socks may be improved. The ability to adjust the juxtapositioning of different twist (or non-twist) levels between component yarns may enable increased, or optimising of, the friction between the component yarns to increase the strength of the multi-ply yarn, and may enable a particular desired surface appearance of the resulting yarn to be achieved or varied. Where a core filament is also incorporated into the yarn this enables a further degree of variability. It may enable a reduction of the twist level necessary to give a multi-ply yarn incorporating the core filament sufficient strength to enable it to be knitted or woven so that for a given weight of yarn the bulk or exposed fibre surface area may be increased. For example multi-ply yarn for use in producing a high quality lightweight knit fabric of wool may be produced so as to have in the individual slivers or strands relatively long areas of twist, in which the degree of twist is low, and shorter areas of non-twist with incorporation into the yarn of a continuous core filament as previously described. Yarn for use in producing terry fabrics may be produced so as to have short areas of medium twist between longer areas of non-twist in the strands of the yarn, and may also incorporate a core filament (to produce the longer areas of non-twist the transverse reciprocal movement of the twist rollers may slow or stop—while forward rotation of the rollers continues—at either end of the transverse roler movement, & the machine may be programmed to move the rollers relatively quickly when they do move transversely, to reduce the length of the twisted areas, during which the forward rotational movement of the rollers may optionally slow for example). For yarns to be used in the production of felted fabrics from coarser wool short areas of twist may be formed between longer areas of non-twist to facilitate matting of fibres in the non-twist areas of yarns forming the fabric with each other in the felting process.

The following comparative analysis shows how products knitted with yarn produced by an apparatus of the invention herein designated as WOOL ULTRA™ yarn or socks with one particular set of rotational speed and transverse throw settings for the twist rollers had particular properties superior to equivalent products knitted with conventionally produced yarn. Socks knitted with WOOL ULTRA™ yarn were perceived by users as more comfortable and resulted in fewer blisters under extreme conditions of wear, such as that experienced by trampers, skiers/snowboarders and members of the armed forces.

Blisters suffered by athletes who must walk or run for prolonged periods can lead to poor performance or even withdrawal from events. For recreational sports participants the discomfort caused by blisters can reduce enjoyment from sporting activities. For military personnel, especially soldiers required to spend long periods of time on foot, blisters can hinder the ability of the individual and the military unit to function effectively in combat.

Friction blisters form in the epidermis (outer skin layer) when the skin cell layers just beneath the surface are subjected to shear forces that result in cleavage of one layer of cells from an adjacent layer. The cavity thus produced fills with fluid and the area becomes raised. Attempts to prevent blistering focus on trying to reduce the skin's coefficient of friction, either directly by the use of lubricants or indirectly by attempting to keep the foot dry (low to moderate moisture levels tend to increase the skin's coefficient of friction). Alternatively, the shear force can be absorbed by an insole or sock with sufficient thickness and appropriate mechanical properties.

There are some general principles for sock fibre type and structure that would help to prevent friction blisters:

1. Fibre type and sock structure should maintain as dry a foot-sock environment as possible in order to prevent a moisture-instigated increase in skin coefficient of friction, and also to prevent moisture from causing temporary loss of sock pile thickness (by casing fibres to adhere together).
2. Sock structure (and to a lesser degree fibre type) should be chosen to:
   (a) dissipate shear force through sliding at an interface outside the epidermis, or
   (b) absorb shear force by allowing the two faces of the sock to move to some degree independently. They should be connected by material that retains thickness but absorbs the shear force as it is displaced sideways.

Condition 1 may be best satisfied by layered wicking structures in situations where the shoe upper does not provide a substantial barrier to moisture vapour (such as lightweight running shoes), or by hygroscopic fibres (such as wool, which can absorb moisture vapour from the environment) when the shoe is impermeable (such as hiking boots). Achievement of condition 2a may be enhanced by the use of slippery fibres (eg, Teflon®) in critical areas, such as the heel and toes (although it is debatable whether having slippery socks is a desirable sensation for the wearer). Condition 2b is achieved by creating a thick pile on the sole of the sock, and using a yarn and fibre that retain thickness well but absorb shear forces.

Comparative Testing of Socks

Three types of socks as described below were knitted from yarn produced on an apparatus of the invention similar to that of FIGS. 2 to 5 with particular twist profile settings (WOOL ULTRA™ yarn), and were tested comparatively as described in the following, with other sock types D to H. All sock types tested were:

A. Wool Ultra™ all-over terry pile sock.
B. Wool Ultra™ terry sole sports sock (anklet).
C. Wool Ultra™ plain (flat sole) sock
D. Conventional wool all-over terry pile sock.
E. Conventional wool terry sole sports sock (anklet).
F. Conventional wool plain (flat sole) sock.
G. Acrylic all-over terry pile sock.
H. Polyester terry sole sports sock (anklet).

This testing allowed the effect of fibre type to be compared between the wool socks and synthetic equivalents, and the effect of yarn construction compared between Wool Ultra™ and conventional wool.

Sock—Moisture Vapour Interaction

The interaction of moisture and the sock is important in blister prevention and in providing a comfortable environment around the foot. As well as increasing the friction between the foot and the sock, the presence of liquid moisture can give an unpleasant damp or clammy sensation. The moisture is perspiration, assuming the appropriate footwear is used to protect the foot from external moisture sources. This perspiration begins to build up around the foot immediately, initially as moisture vapour. As moisture vapour builds up, the relative humidity around the food increases and evenly moisture begins to condense on to the foot and sock. Also, after a period of time the physical exertion being undertaken causes liquid perspiration to be produced as part of the body's cooling mechanism. The sock construction and fibre type will influence the capacity of the sock to interact with the moisture produced by the foot. This is especially important for socks which are to be used under impermeable footwear, such as boots for hiking, skiing or snowboarding.

Testing was carried out on three socks to determine their capacity for holding moisture and how rapidly they absorb and desorb moisture vapour. This will influence how well they maintain dryness inside the shoe during the initial stages of exercise. The capacity of the sock to hold moisture and the rate at which it can take it up is also important.

Figure 11:
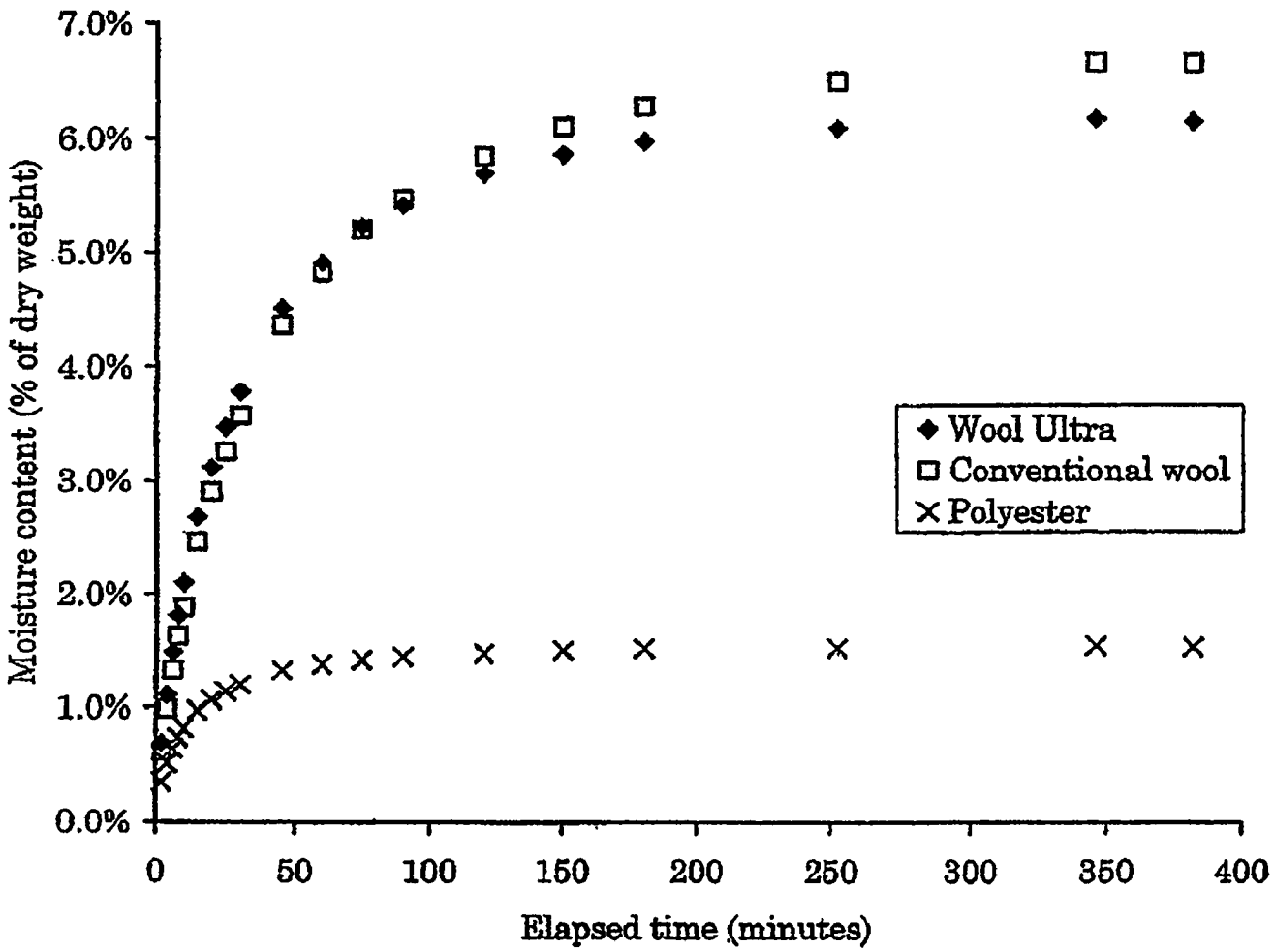

Moisture vapour absorption: The three sports socks were used for this work, that is, B (Wool Ultra), E (conventional wool) and H (polyester). The socks were dried in an oven, weighed in their dry condition, and then placed in a room at 65% relative humidity. The rate at which they absorbed moisture from the environment was measured by weighing the socks at intervals. The moisture absorption curves are shown in FIG. 11. From FIG. 11 it can be seen that the Wool Ultra™ sock's absorption curve is ahead of that of the conventional wool sock for the first 60 minutes of absorption. It falls behind only because it nears its maximum capacity more rapidly than the conventional wool sock and its subsequent rate of absorption slows.

Figure 12:
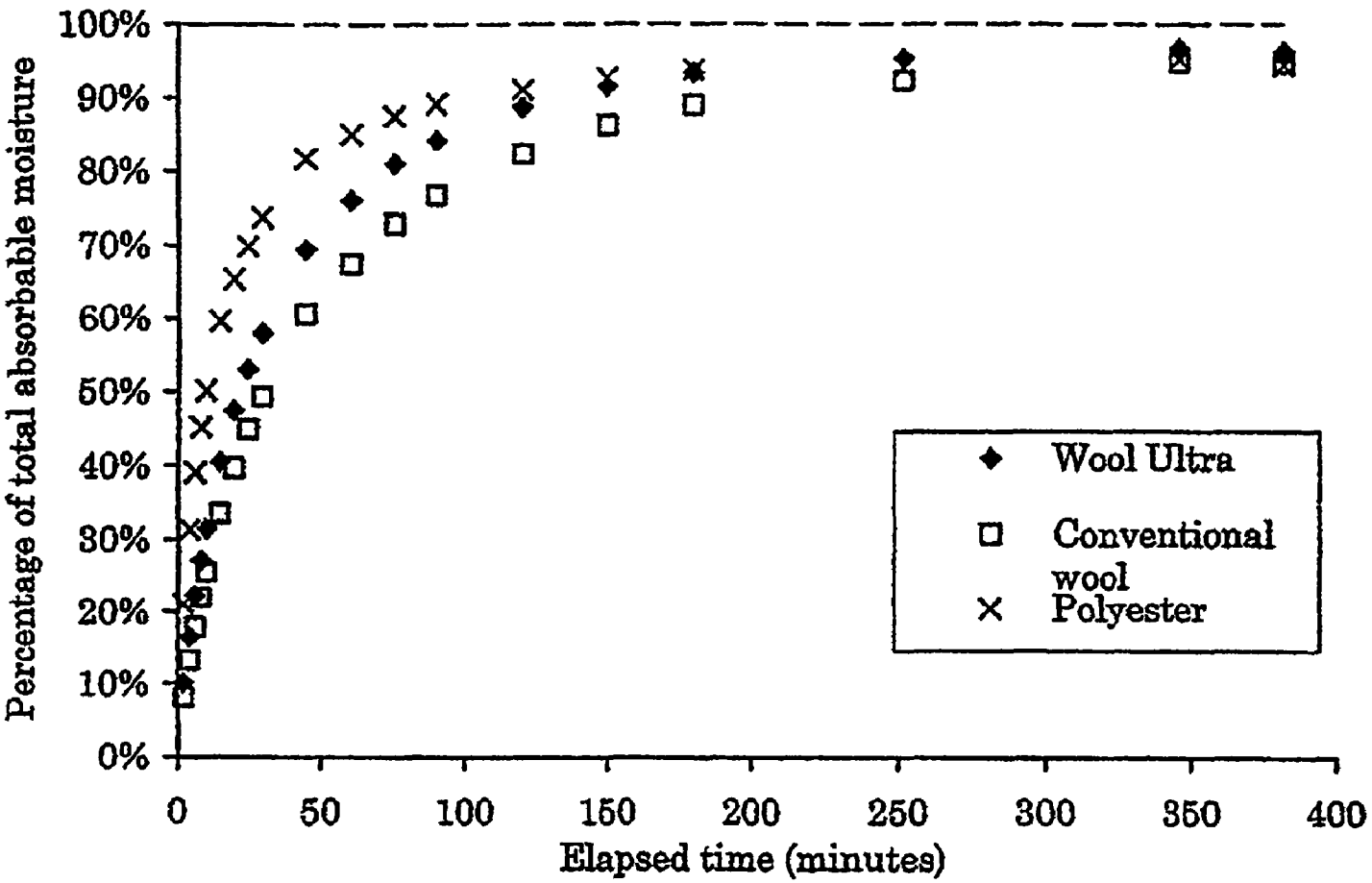

FIG. 12 compares the socks in terms of how rapidly they reach their maximum moisture capacity. It can be seen that the polyester sock nears its maximum capacity the most rapidly, but FIG. 11 shows that this is a very small quantity of moisture. The Wool Ultra™ sock approaches a higher maximum capacity more rapidly than the conventional wool sock. The Wool Ultra™ sock reached 75% of its moisture capacity in about 29% less time than the conventional wool sock.

Moisture vapour desorption: Similar testing was carried out for the moisture desorption (that is, loss of moisture from the fibre to the environment). In this case, the same set of socks as used for moisture absorption were brought to equilibrium with a high humidity environment, then placed in a very low humidity environment (10% relative humidity) and weighed periodically to observe their rate of moisture desorption. The rate of moisture desorption was measured as the time that the specimens take to desorb moisture down to 25% of their maximum level (the values given above). The Wool Ultra™ sock reached the 25% level in 30% less time than the conventional wool. The Wool Ultra™ sock was faster than the polyester sock in reaching this level.

Shear Absorption and Friction

A simulated foot was pulled across the inside surface of the sole of the socks. The foot was a small metal sled with a moderately compressible 'skin' of medium density foam on its lower surface. It was loaded to a pressure roughly equivalent to that applied to a sock when being worn by an adult. The sock was fixed in place. When force is applied to move the sled across the sock sole there is an initial phase when no sliding occurs. During this phase, the pile is absorbing shear, that is, allowing the inner face of the fabric to move with the foot, while the outer face remains static. The deflection that occurs before the foot begins to slide was measured, and is referred to as the shear absorption. It was measured in four directions, along and across the foot in both directions. The force applied when sliding begins indicates the static fiction, and the force required to maintain sliding indicates the dynamic friction. These were also measured in each of the four directions. It was found that the dynamic friction results always followed the same pattern as the static friction results. It is important that these measurements are made under compression, as the ability of the pile to remain thickness may be important to its capacity to absorb shear.

The socks tested in the experiment were A, D, G, C and F, that is the all-over terry socks in Wool Ultra™, conventional wool and acrylic, plus the two flat sole socks in Wool Ultra™ and conventional wool and the results are given in Table 1.

TABLE 1

| Shear absorption of sock soles (mm) | | | | | |
|---|---|---|---|---|---|
| | Along foot | | Along foot | | |
| Sock type | Direction 1 | Direction 2 | Direction 1 | Direction | Ave |
| A. Wool Ultra terry pile | 7.13 | 7.93 | 7.00 | 7.33 | 7.35 |
| B. Conventional wool terry pile | 5.37[a] | 5.20[b] | 5.53 | 6.47 | 5.64 |
| G. Acrylic terry pile | 5.30[a] | 4.93[b] | 5.27 | 5.90 | 5.35 |
| C. Wool Ultra flat knit | 5.87 | 5.47 | — | — | 5.67 |
| F. Conventional wool flat knit | 4.80 | 5.00 | — | — | 4.90 |

[a]With nap
[b]Against nap

Only the conventional wool and the acrylic terry pile had an obvious nap, and only in the 'along foot' orientation (this is noted in Table 1.) The flat soles were not filly tested, as the terry soles were the main interest.

From Table 1 it is clear that the Wool Ultra™ terry pile displaces further than both the conventional wool and the acrylic pile before yielding to the shear force and starting to slide. The shear absorption of the Wool Ultra sock is 30% higher than that of the conventional wool terry sock and 37% higher than the acrylic terry sock. Under this compression the conventional wool and acrylic piles have less capacity to absorb shear force than even the flat constructed Wool Ultra™ sock However, the sock should not allow the shear stress to build up to high levels, even if it does allow a large amount of displacement, because this force will be transferred to the foot until sliding occurs between sock and foot. This 'force to start sliding' is a measure of the static friction, and measurements of this are given in Table 2.

TABLE 2

| Static friction of sock soles (kg, force to start sliding) | | | | | |
|---|---|---|---|---|---|
| | Along foot | | Along foot | | |
| Sock type | Direction 1 | Direction 2 | Direction 1 | Direction | Ave |
| A. Wool Ultra terry pile | 1.140 | 1.157 | 1.073 | 1.083 | 1.113 |
| B. Conventional wool terry pile | 1.197[a] | 1.337[b] | 1.197 | 1.220 | 1.238 |
| G. Acrylic terry pile | 1.047[a] | 1.027[b] | 0.953 | 0.930 | 0.989 |
| C. Wool Ultra flat knit | 1.187 | 1.203 | — | — | 1.195 |
| F. Conventional wool flat knit | 1.213 | 1.200 | — | — | 1.206 |

[a]With nap
[b]Against nap

The Wool Ultra™ pile fabric has a lower friction than the conventional wool pile and does not display any obvious direction effect, except that both measurements across the foot are lower than those along the foot. The conventional wool pile has a large directional effect along the foot. The pile has an obvious nap ad, as expected, the force required to start sliding against the nap is higher than that to start sliding with the nap. The static friction of the Wool Ultra™ pile is 10% lower than that of the conventional wool pile.

The combination of results shown in Tables 1 and 2 indicates that the Wool Ultra™ sock pile has the capacity to absorb more shear displacement than conventional wool and acrylic sock piles, as well as the two flat sock soles, while having lower friction than the conventional wool socks tested. During wear the Wool Ultra pile will transfer less shear stress to the foot than the conventional wool pile.

Thickness Retention

Shear and friction testing were carried out with the pile under compression to provide a testing environment which is closer to that experienced in wear, when the sock's thickness has been reduced substantially. The simulated foot used in the tests had a contact area with the sock specimen of $1.296\times10^{-3}$ $m^2$ and was loaded with a 2.5 kg weight (in addition to its own mass of 135 g). This gave a comprehensive pressure of 20.33 kPa, which is roughly equivalent to the foot pressure applied by a person of about 99 kg.

The thickness that a sock sole has under this level of compression may be important to its comfort and shear absorption properties. The five specimens tested had their thickness measured under two conditions: firstly at as close to zero pressure as possible, and secondly at the pressure used during the shear and friction testing. The results are given in Table 3.

TABLE 3

| Thickness of sock soles | | | |
|---|---|---|---|
| Sock type | Thickness at low pressure (mm) | Thickness at testing pressure (mm) | Pile Compre (%) |
| A. Wool Ultra terry pile | 6.13 | 3.34 | 45.5 |
| B. Conventional wool terry pile | 4.47 | 1.63 | 63.5 |
| G. Acrylic terry pile | 5.63 | 1.55 | 72.5 |

TABLE 3-continued

| Sock type | Thickness of sock soles: Thickness at low pressure (mm) | Thickness at testing pressure (mm) | Pile Compre (%) |
|---|---|---|---|
| C. Wool Ultra flat knit | 3.67 | 2.00 | 45.4 |
| F. Conventional wool flat knit | 2.53 | 1.42 | 43.8 |

In all cases a substantial amount of the sock's thickness has been lost. This underlines the importance of testing under these realistic conditions. It is clear that the terry pile socks generally lose more thickness than the flat constructions, which is to be expected, given their low density construction which is intended to yield to foot pressure. It is notable, however, that the Wool Ultra™ terry pile is compressed by only 46%, whereas the conventional wool and acrylic socks are compressed by 64% and 73%, respectively. This means that there is a lot more thickness of pile remaining to absorb shear in the case of the Wool Ultra™ sock. In fact, under low pressure the Wool Ultra™ sock was only 37% thicker than the conventional wool sock, whereas the pressure used in the testing it was 105% thicker.

Apparatus of the invention may be used for producing yarns from staple fibres of wool, cotton, synthetics or a blend or mixture of such staple fibres, optionally also incorporating a continuous filament as described.

The foregoing describes the invention including preferred forms thereof. Alterations and modifications as will be obvious to those skilled in the art are intended to be incorporated within the scope hereof as defined in the accompanying claims.

The invention claimed is:

1. Apparatus for producing a yarn from one or more slivers, the apparatus including:

a first reciprocating twisting stage including one or more twist rollers arranged to move reciprocally along the axis of rotation of the one or more twist rollers for simultaneously twisting said one or more slivers;

a non-reciprocating roller for pressing a core filament into a respective one of said slivers as said filament and sliver are pressed against the non-reciprocating roller;

a guide for passing a core filament and a respective one of said slivers against the non-reciprocating roller prior to the first reciprocating twisting stage; and a control system for controlling variation of one or both of (a) the rotational speed of the one or more twist rollers and (b) the speed of the one or more twist rollers along said axis of rotation, to vary the twist profile imparted to the yarn.

2. Apparatus according to claim 1, wherein the control system enables a user to program a twist profile to be imparted to a production run, series of production runs, or part run, of yarn.

3. Apparatus according to claim 2, wherein the control system is microprocessor based and includes a user operable keyboard and display.

4. Apparatus according to claim 1, wherein the apparatus also includes one or more guides positioned after the one or more twist rollers to cause one or more of the strands to pass over a longer path than one or more other strands before the strands are brought together to form a multi-ply yarn, one or more of which guides are movable to enable variation of the position of one or more guides between production runs.

5. Apparatus according to claim 4, wherein the apparatus also includes an electro-mechanical guide repositioning system for moving one or more of said guides, wherein the repositioning system is also programmably controllable by the control system of the apparatus.

6. Apparatus according to claim 1, wherein the apparatus also includes a second said reciprocating twisting stage after the first reciprocating twisting stage and wherein said second reciprocating twisting stage is arranged to impart twist to the sliver(s) in areas of non-twist that are located between areas of twist imparted to the sliver(s) by the first reciprocating twist stage.

7. A method of using the apparatus of claim 1 to produce a yarn from one or more slivers, the method comprising using said guide to pass a core filament and a respective one of said slivers against a non-reciprocating roller;

using the non-reciprocating roller to press the core filament into the sliver;

subsequently passing the one or more slivers between the reciprocating one or more twist rollers to simultaneously twist the slivers; and using the control system to vary the rotational speed of the one or more twist rollers and/or the speed of reciprocal movement of the one or more twist rollers and/or the extent of reciprocal movement of the one or more twist rollers along the axis of rotation.

8. Apparatus for producing a yarn from one or more slivers, the apparatus including:

a first reciprocating twisting stage including one or more twist rollers arranged to move reciprocally along the axis of rotation of the one or more twist rollers for simultaneously twisting said one or more slivers;

wherein the one or more twist rollers are mounted so that the extent of reciprocal movement of the one or more twist rollers along the axis of rotation can be controlled and varied to vary a twist profile imparted to the yarn.

9. Apparatus according to claim 8, wherein the control system enables a user to program the twist profile to be imparted to a production run, series of production runs, or part run, of yarn.

10. Apparatus according to claim 9, wherein the control system is microprocessor based and includes a user operable keyboard and display.

11. Apparatus according to claim 8, wherein the apparatus also includes one or more guides positioned after the one or more twist rollers to cause one or more of the strands to pass over a longer path than one or more other strands before the strands are brought together to form a multi-ply yarn, one or more of which guides are movable to enable variation of the position of one or more guides between production runs.

12. Apparatus according to claim 11, wherein the apparatus also includes an electro-mechanical guide repositioning system for moving one or more of said guides, wherein the repositioning system is also programmably controllable by the control system of the apparatus.

13. Apparatus according to claim 8, wherein the apparatus also includes a second said reciprocating twisting stage after the first reciprocating twisting stage and wherein said second reciprocating twisting stage is arranged to impart twist to the one or more slivers in areas of non-twist that are located between areas of twist imparted to the one or more slivers by the first reciprocating twist stage.

14. Apparatus according to claim 8, wherein the apparatus further includes:

a control system for controlling variation of the rotational speed of the one or more twist rollers and the extent of reciprocal movement of the one or more twist rollers along the axis of rotation to enable further variation of the twist profile imparted to the yarn.

15. Apparatus according to claim 14, wherein the control system enables a user to program the twist profile to be imparted to a production run, series of production runs, or part run, of yarn.

16. Apparatus according to claim 15, wherein the control system is microprocessor based and includes a user operable keyboard and display.

17. Apparatus according to claim 14, wherein the apparatus also includes one or more guides positioned after the one or more twist rollers to cause one or more of the strands to pass over a longer path than one or more other strands before the strands are brought together to form a multi-ply yarn, one or more of which guides are movable to enable variation of the position of one or more guide(s) between production runs.

18. Apparatus according to claim 17, wherein the apparatus also includes an electro-mechanical guide repositioning system for moving one or more of said guides, wherein the repositioning system is also programmably controllable by the control system of the apparatus.

19. Apparatus according to claim 14, wherein the apparatus also includes a second reciprocating twisting stage after the first reciprocating twisting stage and wherein said second reciprocating twisting stage is arranged to impart twist to the one or more slivers in areas of non-twist that are located between areas of twist imparted to the one or more slivers by the first reciprocating twist stage.

20. Apparatus according to claim 8, wherein the apparatus further includes:

a control system for controlling variation of the speed and extent of reciprocal movement of the one or more twist rollers along the axis of rotation to enable further variation of the twist profile imparted to the yarn.

21. Apparatus according to claim 20, wherein the control system enables a user to program the twist profile to be imparted to a production run, series of production runs, or part run, of yarn.

22. Apparatus according to claim 21, wherein the control system is microprocessor based and includes a user operable keyboard and display.

23. Apparatus according to claim 20, wherein the apparatus also includes one or more guides positioned after the one or more twist rollers to cause one or more of the strands to pass over a longer path than one or more other strands before the strands are brought together to form a multi-ply yarn, one or more of which guides are movable to enable variation of the position of one or more guides between production runs.

24. Apparatus according to claim 23, wherein the apparatus also includes an electro-mechanical guide repositioning system for moving one or more of said guides, wherein the repositioning system is also programmably controllable by the control system of the apparatus.

25. Apparatus according to claim 20, wherein the apparatus also includes a second said reciprocating twisting stage after the first reciprocating twisting stage and wherein said second reciprocating twisting stage is arranged to impart twist to the one or more slivers in areas of non-twist that are located between areas of twist imparted to the one or more slivers by the first reciprocating twist stage.

26. Apparatus according to claim 8, wherein the apparatus further includes:

a control system for controlling variation of the rotational speed of the one or more twist rollers and the speed and extent of reciprocal movement of the one or more twist rollers along the axis of rotation to enable further variation of the twist profile imparted to the yarn.

27. Apparatus according to claim 26, wherein the control system enables a user to program the twist profile to be imparted to a production run, series of production runs, or part run, of yarn.

28. Apparatus according to claim 27, wherein the control system is microprocessor based and includes a user operable keyboard and display.

29. Apparatus according to claim 26, wherein the apparatus also includes one or more guides positioned after the one or more twist rollers to cause one or more of the strands to pass over a longer path than one or more other strands before the strands are brought together to form a multi-ply yarn, one or more of which guides are movable to enable variation of the position of the one or more guides between production runs.

30. Apparatus according to claim 29, wherein the apparatus also includes an electro-mechanical guide repositioning system for moving one or more of said guides, wherein the repositioning system is also programmably controllable by the control system of the apparatus.

31. Apparatus according to claim 26, wherein the apparatus also includes a second said reciprocating twisting stage after the first reciprocating twisting stage and wherein said second reciprocating twisting stage is arranged to impart twist to the one or more slivers in areas of non-twist that are located between areas of twist imparted to the one or more slivers by the first reciprocating twist stage.

32. Apparatus according to any one of claims 8, 14, 20 and 26, wherein the apparatus includes a non-reciprocating roller for pressing a core filament into a respective one of said slivers as said filament and sliver are pressed against the non-reciprocating roller, and a guide for passing a core filament and a respective one of said one or more slivers against the non-reciprocating roller prior to the first reciprocating twisting stage.

33. Apparatus according to any one of claims 8, 14, 20, and 26, wherein the apparatus also includes a pair of drafting rollers or drafting belts before the first reciprocating twisting stage.

34. A method of using the apparatus of claim 32 to produce a yarn from one or more slivers, the method comprising using said guide to pass a core filament and a respective one of said slivers against a non-reciprocating roller;

using the non-reciprocating roller to press the core filament into the respective one of said slivers;

subsequently passing the one or more slivers between the one or more twist rollers to simultaneously twist the slivers; and using the control system to vary the rotational speed of the one or more twist rollers and/or the speed of reciprocal movement of the one or more twist rollers and/or the extent of reciprocal movement of the one or more twist rollers along the axis of rotation to create a yarn having a predetermined twist profile.

* * * * *